US006125662A

United States Patent [19]

Bizer et al.

[11] Patent Number: 6,125,662

[45] Date of Patent: Oct. 3, 2000

[54] HIGH-LOW PLUSH KNITWEAR AND METHOD AND APPARATUS FOR MAKING IT

[75] Inventors: Erich Bizer; Juergen Mueller; Walter Schmid, all of Albstadt, Germany

[73] Assignee: Sipra Patententwicklungs- u. Beteiligungsgesellschaft mbH, Albstadt, Germany

[21] Appl. No.: 09/025,175

[22] Filed: Feb. 18, 1998

[30] Foreign Application Priority Data

Feb. 21, 1997 [DE] Germany ..... 197 07 053

[51] Int. Cl.[7] ..... D04B 9/12

[52] U.S. Cl. ..... 66/92; 66/191; 66/194

[58] Field of Search ..... 66/91, 92, 93, 66/104, 107, 136, 169 R, 190, 191, 194

[56] References Cited

U.S. PATENT DOCUMENTS

| | | |
|---|---|---|
| 4,409,800 | 10/1983 | Gutschmit et al. . |
| 4,986,090 | 1/1991 | Lombardi . |
| 5,239,843 | 8/1993 | Plath et al. . |

FOREIGN PATENT DOCUMENTS

| | | |
|---|---|---|
| 0 295 703 A2 | 12/1988 | European Pat. Off. . |
| 31 45 307 A1 | 6/1983 | Germany . |
| 30 24 705 C2 | 4/1986 | Germany . |
| 39 27 815 A1 | 2/1991 | Germany . |
| 40 33 735 A1 | 4/1992 | Germany . |
| 30 24 705 C2 | 4/1996 | Germany . |
| 195 05 646 A1 | 8/1996 | Germany . |
| 2 235 470 | 3/1991 | United Kingdom . |

*Primary Examiner*—Danny Worrell
*Attorney, Agent, or Firm*—Michael J. Striker

[57] ABSTRACT

A high/low plush knitwear with a ground fabric including a plurality of stitch courses and plush yarns (72,81) bound thereinto is disclosed. The ground fabric consists of knitting formed from at least one ground yam (68) and comprises at least one first portion (77) formed by a plurality of adjacent stitch wales with incorporated plush yarns (72,81) forming plush loops (72*d*, 81*d*) and at least one second portion (78) without such plush loops. According to the invention at least two float yarns (64,65) are additionally bound into the ground fabric. Each float yarn (64,65) in the second portion (78) selectively floats or is formed into stitches (80*e*–80*h*). The invention moreover concerns a method and a knitting machine for making such a plush knitwear (FIG. 16).

17 Claims, 9 Drawing Sheets

77
78
80a
79a
80b
79b
80c
79c
80d
79d
80e
79e
80f
79f
80g
79g
80h
79h
68
64
65
81
72
72a
65a
65b
73
81a
72b
65c
64a
64b
64c
65d
64d
81b
81c
72c
a
b
c
d

HIGH-LOW PLUSH KNITWEAR AND METHOD AND APPARATUS FOR MAKING IT

BACKGROUND OF THE INVENTION

This invention relates to a high-low plush knitwear which comprises a base fabric having a plurality of stitch courses knitted with at least one first ground yarn, and at least one plush yarn bound into said base fabric, wherein said base fabric has at least one first portion with plush loops formed by said at least one plush yarn being bound into said first portion, and at least one second portion without having plush loops being formed by said plush yarn.

This invention further relates to a method of making such high/low fabrics on a knitting machine with knitting elements having hooks and first and second sinkers associated therewith in pairs and adapted to be advanced and retracted transverse to the knitting elements, to which sinkers ground and plush yarns are fed for forming ground and plush yarn stitches and the plush yarn loops, wherein the ground yarn is firstly laid into the hooks of the raised knitting elements in a first system section, and is preformed into ground yarn loops over sinker edges of the first sinkers by following lowering of these knitting elements, wherein at least one plush yarn is laid into the hooks of selected knitting elements raised again in a second system section lying after the first system section in the knitting direction, and is preformed over sinker edges of the second sinkers into plush yarn loops by lowering these knitting elements, wherein then the knitting elements are lowered to the knock-over position for forming stitches of the ground and plush yarn in a third system section lying after the second system section in the knitting direction, and wherein no plush yarn is laid into the hooks of a plurality of directly adjacent knitting elements for making high/low patterns.

This invention further relates to a knitting machine for making the above mentioned high/low plush fabrics. Such a knitting normally has a needle carrier, in which knitting elements for forming ground and plush yarn loop stitches are movably mounted, at least one ground yarn guide for feeding a ground yarn, at least one plush yarn guide for feeding a plush yarn, a sinker carrier in which first and second sinkers are movably mounted, arranged in pairs, for controlling the stitch formation, wherein the first sinkers have edges for preforming ground yarn loops and the second sinkers have edges for preforming plush yarn loops, and at least one cam system arrangement associated with at least one of the yarn guides for controlling the knitting elements and sinkers, wherein the cam system arrangement comprises a first system section for laying the ground yarn into the hooks of the raised knitting elements and for subsequent lowering of these knitting elements for preforming ground yarn loops over the edges of the first sinkers, a second system section lying after the first system section in the knitting direction for laying the plush yarn into the hooks of selected knitting elements raised again and for subsequent lowering of these knitting elements for preforming the plush yarn loops over the edges of the second sinkers and a third system section lying after the second system section in the knitting direction for lowering the knitting elements into a knock-over position for forming stitches from the ground and plush yarns.

The expression high-low plush knitwear usually means a knitwear which has at least one zone or portion consisting of plurality of adjacent stitch wales with long (high) plush loops worked in and at least one zone or portion consisting of a plurality of adjacent stitch wales having no plush loops or at most very short (low) plush loops. The production of such goods is effected for example simply by laying no plush yarns into the associated knitting needles in accordance with a pattern, in the zones which are to have no plush loops. The plush yarns therefore form continuous floats, i.e. floating loops in these zones, which are cut off and removed in the customary subsequent cropping operation, while the resultant plush yarn loops in the zones with worked-in plush yarns are cut open and the desired cut plush loops are thereby formed. The finished plush knitwear therefore has high zones with plush loops and low zones without plush loops, in which the usually smooth ground knitting is visible, formed by the plain knitted construction of the base or ground fabric. Alternatively, it would be possible to work the plush yarns into the stitches together with the ground yarn in the zones without plush loops.

In order to make such high-low plush knitwear the methods and apparatuses of the kind initially referred to in particular are known (DE 3 145 307 A1, DE 4 033 735 A1, DE 195 05 646 A1). In use thereof the knitting needles and sinkers are so controlled relative to one another that ground yarn loops are preformed in a first system section of the knitting machine, preferably with all knitting needles, and in a subsequent system section plush yarns loops selected optionally in accordance with a pattern, are preformed and only then all knitting needles are moved to a knock-over position for the stitch formation. Alternatively, it is also known initially to lay the ground yarn only into the sinker throats and to leave it in these also during the formation of the plush yarn loops (EP 0 295 703 C2).

It would be possible with a useful development of this principle to incorporate at least one further ground yarn in the smooth plain ground fabric of the described plush fabric, e.g. with a 1:1 float pattern (DE 3 927 815 A1). However, it is alternatively also possible to provide other float patterns, e.g. with the knitting construction 2:1, 3:1, etc. or otherwise as the float pattern. A particular advantage of this kind of method is that no partial courses (sub-courses) result and even with coloured patterning a so-called full plush knitwear can always be produced, in which each stitch within a stitch course is provided with plush loops.

The object aimed at with the described ground fabric produced from at least two ground yarns is to make the plush fabric more secure against laddering and more mechanically stable, than would be with use of pure plain knitting. The optical appearance of the ground knitting in the low zones is generally less important and subservient to the desired properties of the knitting.

In the use of other know methods for making plush fabrics only those knitting needles are raised under system control which are also intended to take the plush yarn. In order to avoid both the plush and the ground yarns floating in the low zones having no plush yarn, those knitting needles which receive no plush yarn in accordance with the pattern are so controlled that either these needles only receive the ground yarn or the ground yarn is bound at least partially into the ground fabric in the low zones with various tuck and/or float patterns (e.g. DE 3 024 705 A1). This leads in the first place to the formation of sub-courses, which is undesirable in principle and in the second place to a fabric which indeed has a higher plush density but which has an optically less satisfactory appearance in the presence of low zones of greater width.

SUMMARY OF THE INVENTION

It is an object of this invention to so design the plush knitwear above specified that it has a nice appearance and selected mechanical properties, when needed, also in the zones having no plush loops.

A further object of this invention is to provide the plush knitwear with full colored plush patterns and nevertheless to influence the mechanical characteristics of the knitwear when needed.

Yet another object of this invention is to provide the plush knitwear with zones having plush loops and zones without plush loops and to incorporate float yarns at least into the zones having no plush loops.

A further object of this invention is to suggest a method of making the high/low plush knitwear according to this invention.

A further object of this invention is to change the method mentioned above in such a manner that additional float yam can be incorporated into zones of the knitwear not having plush loops.

A still further object of this invention is to propose a knitting machine on which the high/low plush knitwear of this invention can be made by using the method of this invention.

And yet another object of this invention is to so design the knitting machine mentioned above that it is provided with means to incorporate at least two float yarns into the knitted plush fabric.

The high/low plush knitwear of this invention is characterized in that at least two float yarns are additionally bound into the base fabric and that each float yarn in the second portion selectively floats or is formed into stitches.

The method of making such a high/low plush fabric according to this invention is characterized in that at least two float yarns are laid into the hooks of selected, raised knitting elements in a fourth system section preceding the second system section in the knitting direction, are preformed over sinker edges of the first sinkers by following lowering of these knitting elements into float yarn loops or are left floating and are then bound into the ground fabric together with the ground and plush yarn loops in the third system section by being formed into stitches or left floating between such stitches.

The knitting machine for making the high/low plush fabric of this invention is characterized in that it is provided with at least two further yarn guides each for feeding a float yarn and the cam system arrangement includes at least one fourth system section lying ahead in the knitting direction of the second system section and comprising means for laying the float yarns into the hooks of knitting elements selected and raised and means for forming float yarn loops over the edges of the first sinkers.

Further advantageous features of the invention appear from the claims.

The invention will be explained in more detail below in conjunction with the accompanying drawings of an embodiment:

DESCRIPTION OF PREFERRED EMBODIMENT

Figure 1:
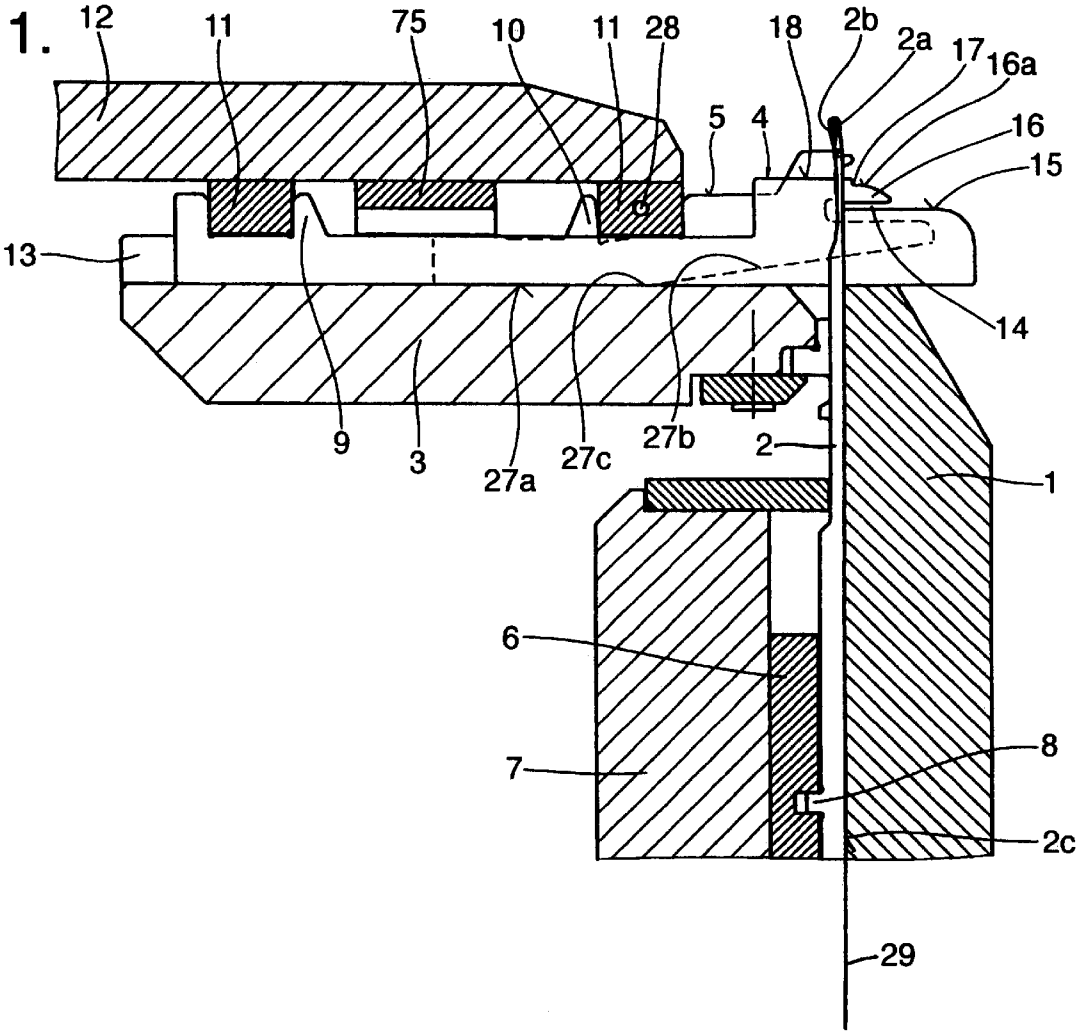
FIG. 1 is a schematic longitudinal section through a circular knitting machine according to the invention for making patterned plush knitwear.

The plush knitwear according to the invention can be made in particular by means of methods and apparatus which have means for forming the ground and plush yarn loops and which are explained fully in DE 3 145 307 A1, DE 4 033 735 A1 and DE 195 05 646 A1. These references are therefore made part of the subject matter of the present application in order to avoid repetitions and are explained only to the extent necessary to understand the modifications to the known methods and apparatuses important for the invention.

The invention starts in the embodiment from a known circular knitting machine with tiltable sinkers (DE 4 035 737 A1). According to FIG. 1 such a circular knitting machine comprises a knitting element carrier 1 in the form of a rotatably mounted needle cylinder, in which knitting elements, in particular normal latch needles 2 with hooks 2*a* and latches 2*b* are movably mounted, and a sinker carrier 3 in the form of a sinker dial rotatable with the needle cylinder 1, in which sinkers 4 and 5 are movably mounted. The two sinkers 4 and 5 are arranged in pairs in tricks of the sinker carrier 3 and one such pair is associated with each needle 2. The needles 2 have a butt 8 controlled by cam system parts 6 of a needle cam system 7 and the sinkers 4 and 5 each have a butt 9 and 10 respectively, which is controlled by cam system parts 11 of a sinker cam system 12. The needle and sinker cam systems 7 and 12 respectively are components of a cam system arrangement (FIG. 2), wherein the needles 2 and the needle cam system 7 serve essentially to form the ground and plush yarn stitches and the sinkers 4 and 5 and the sinker cam system 12 essentially control the ground and plush yarn loops during their formation.

The sinkers 4 and 5 are arranged in pairs in tricks or channels of the sinker carrier 3, these tricks being formed by webs 13 of the sinker carrier 3. Since the sinker 5 is partially obscured in FIG. 1 by the sinker 4, the two sinkers 4 and 5 are shown beside one another in FIG. 2. The sinkers 4 are formed in known manner as holding down and knocking-over sinkers and each comprise a lower edge 15 at their front end, above their bottom edges, each edge 15 running into a longitudinal slot 14, and a nose 16 located above this, which bounds the longitudinal slot 14 with its lower edge and is provided with an upper edge 16*a* inclined slightly down to the front, with its rear end connected by a shoulder 17 to an edge 18 disposed still further to the rear and above the nose 16. The edges 18 and 15 are essentially parallel to the bottom edge. On the other hand, the sinker 15 is in the form of a tilting plush sinker and is provided at its front end with a recess 21 (FIG. 2), which is bounded by an edge 22 running up to the front end of the sinker 5 and a nose 23, which lies above the edge 2 but which is shorter than the edge 22, measured from the bottom of the recess 21. The nose 23 has an edge 24 on its upper side extending to its front end and visible also in FIGS. 3 and 5, with its rear end running via a shoulder 25 into a somewhat higher edge 26 positioned further to the rear. Moreover the sinker 5 has a bottom edge which is formed by two limbs 27*a* and 27*b*, which converge at an oblique angle in a central tip 27*c*. When the sinkers 5 bear with their limbs 27*a* on the bottom of the tricks of the sinker carrier 3 formed by the webs 13, they can be tilted clockwise about their tips 27*c* into a position in which their limbs 27*b* bear on the trick bottoms. The reverse turning is naturally also possible. The pivotal axis is arranged perpendicular to the webs 13. Since the tip 27*c* of the sinker 5 in FIGS. 1 and 3 to 13 is covered by the other sinker 4, its precise position in a direction parallel to the webs 13 is indicated throughout in the drawings by a point 28 surrounded by a small circle. Moreover in FIGS. 3 to 13 that plane is indicated in each case by means of a vertical line 29 in which the back 2*c* (FIG. 2) of the needle 2 considered in the particular case or the bottom of the associated trick is located in the knitting element carrier 1. Finally the edges 24,26 of the sinker 5 protrude above the upper edge 18 of the sinker 4 when the limb 27*a* of the sinkers bears on the bottom of the trick. If however the limb 27*b* of the sinker 5 bears on the bottom of the trick, the edge 24 is substantially at the same height as the edge 16*a* of the sinker 4 at its highest point.

Figure 2:
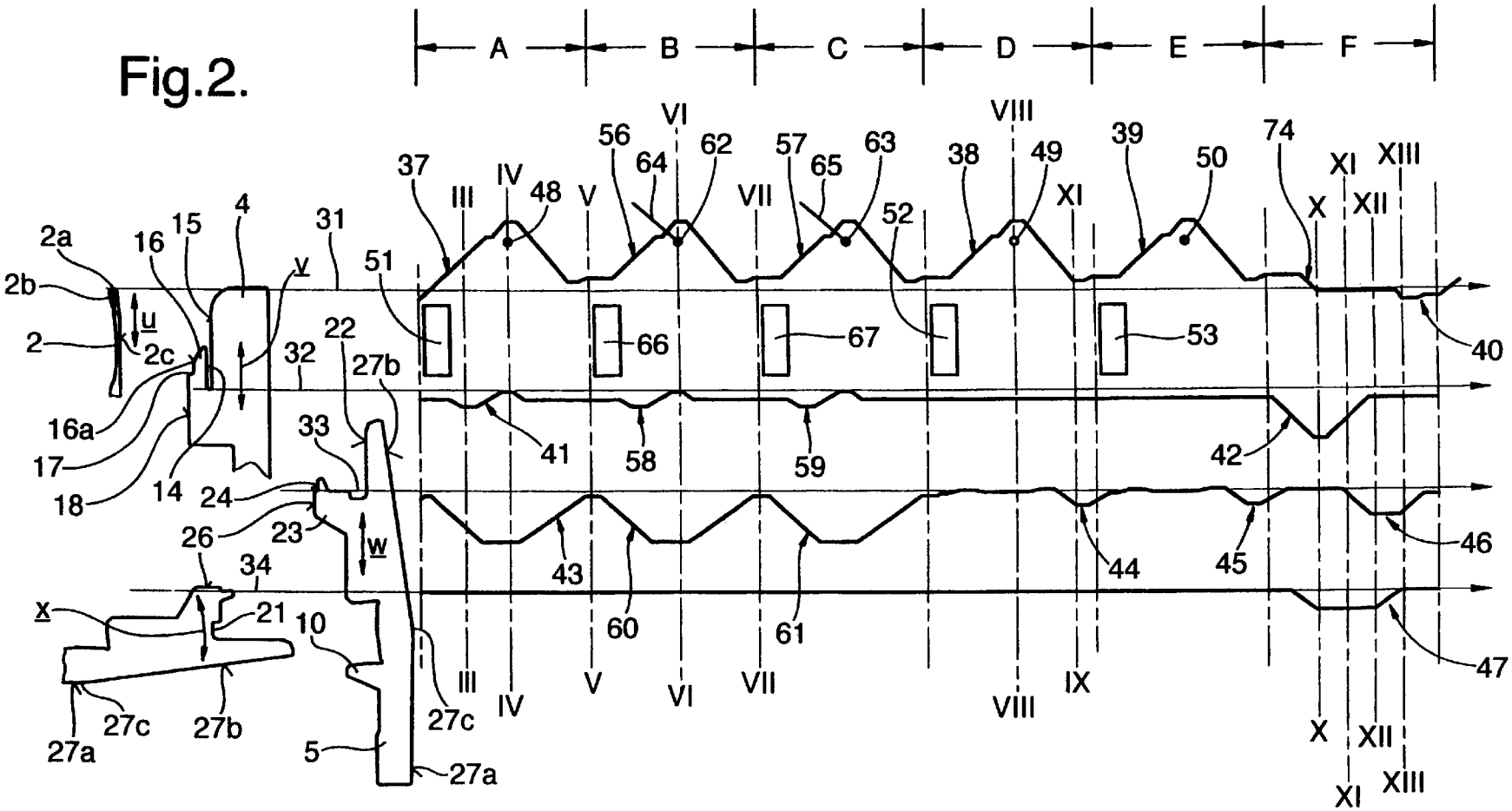
FIG. 2 is a schematic front view of a cam system arrangement according to the invention of the circular knitting machine according to FIG. 1 in developed condition.
Figure 3:
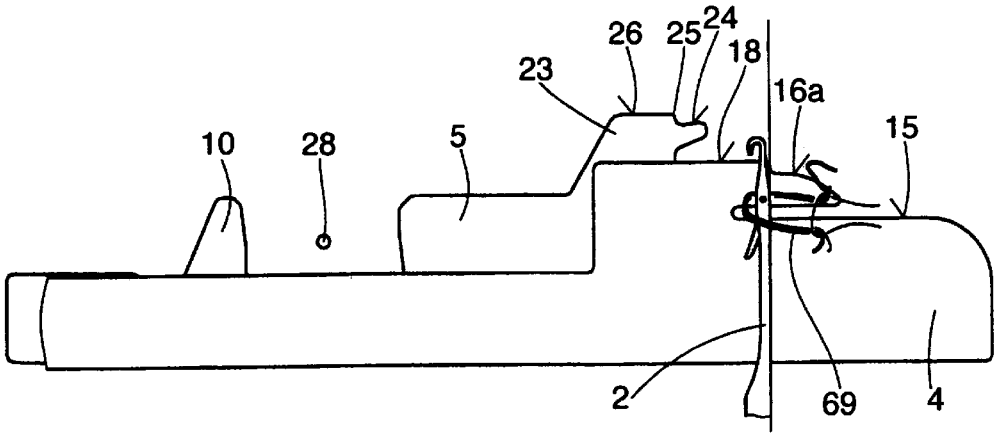
FIGS. 3 to 13 show the relative position of the knitting elements and sinkers at the locations denoted III—III to XIII—XIII of FIG. 2 during a knitting process.

FIG. 2 shows a section of the cam system arrangement of the circular knitting machine schematically, for knitting a two-coloured plush fabric for example. That position which the hooks 2*a* of the needles 2 assume when these are in their miss or non-knitting position are shown by a line 31. That position to which the sinkers 4 are advanced the furthest in the direction of the needles 2 is shown by a line 32 corresponding to the position furthest to the right in FIG. 1. A line 33 correspondingly indicates the furthest advanced position of the sinkers 5. The lines 32 and 33 correspond essentially to the line 29 in FIGS. 3 to 13, so that downwards displacements of the sinkers 4 and 5 in FIG. 2 correspond to a radial retraction from the line 29 to the left in FIGS. 1 and 3 to 13 and an upwards displacement of the sinkers 4 and 5 corresponds to a radial advance in the direction of the needles 2. Finally, a line 34 indicates the highest position of the edges 24 of the noses 23 when their limbs 27*a* bear on the trick bottom. Moreover the possible movements of the needles 2 and sinkers 4 and 5 are indicated by arrows u, v, w and x in FIG. 2.

The tracks on which the needles 2 and sinkers 4,5 can be guided during the knitting operation are indicated in FIG. 2 by the lines 31 to 34 and track sections 37 to 47 branching thereform. All these track sections 37 to 47 are implemented in a manner known per se by means of cam system parts or the like, which act on the butts 8, 9 and 10 of the knitting elements 2 and sinkers 4 and 5 and which are omitted FIG. 2 to simplify the representation.

Yarn guides 48 to 50 are provided in known manner to feed a ground yarn, a plush yarn with a first characteristic, e.g. colour, and a plush yarn with a second characteristic, e.g. colour. In order to select those needles 2 which are to receive any of the yarns, selector devices 51, 52 and 53 are associated with the needles 2 or jacks or the like associated therewith ahead of the rising regions of the track sections 37, 38 and 39, likewise in known manner, and cooperate with suitably formed cam system parts. Further, it is assumed here that a circular knitting machine with a rotating needle cylinder 1 and a stationary cam system arrangement is provided, although this could equally be inverted. The running direction of the needles 2 and sinkers 4 and 5, also called the knitting direction below, is given by the arrowheads on the right ends of the lines 31 to 34 in FIG. 2.

Further track sections of the cam system arrangement are provided according to the invention between the track sections 37, 41 and 43 on the one hand and the track sections 38, 42 and 44 on the other hand. In particular two track sections 56 and 57 corresponding to the track section 37 are provided between the track sections 37 and 38, two track sections 58 and 59 corresponding to the track section 41 between the track sections 41 and 42 and two track sections 60 and 61 corresponding to the track section 43 between the track sections 43 and 44. Yarn guides 62 and 63 are associated with each of the track sections 56 and 57 and are arranged just like the yarn guide 48, but each serve to feed a respective schematically indicated float yarn 64,65. A farther selector device 66,67 is moreover associated with each track section 56,57. The circular knitting machine thus has six system sections A to F arranged one after the other in the knitting direction, of which the sections A, D, E and F serve in known manner to make plush goods with relatively long plush yarn loops, i.e. "high" zones, while the system sections B and C are responsible according to the invention for the insertion of additional float yarns and thus for the design of the "low" zones, as is explained below. The production of for example a two-colour high/low plush knitwear is effected using the circular knitting machine explained with reference to FIGS. 1 and 2 in known manner in relation to the formation of the high zones (e.g. as in DE 4 033 735 A1), so that the method described below results, if also the additional float yarns are taken into account.

Figure 4:
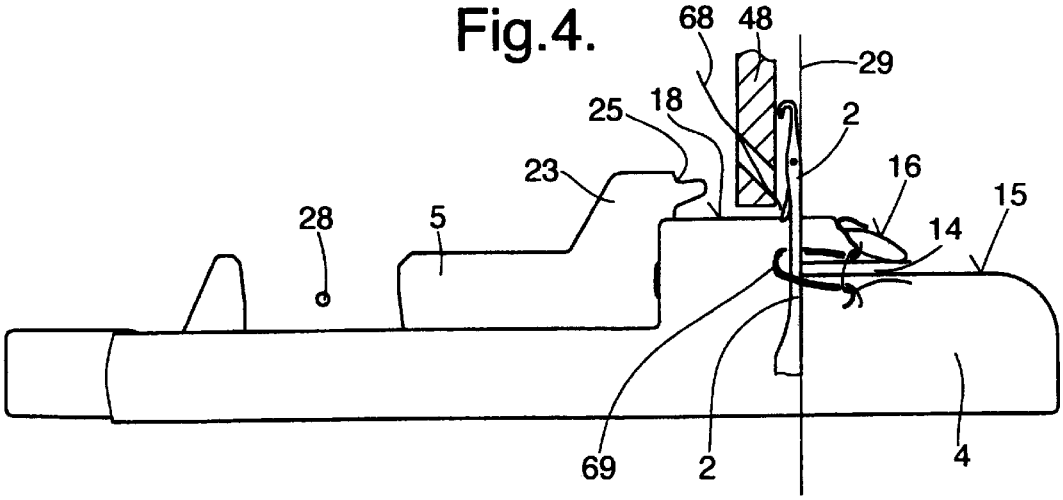
Figure 5:
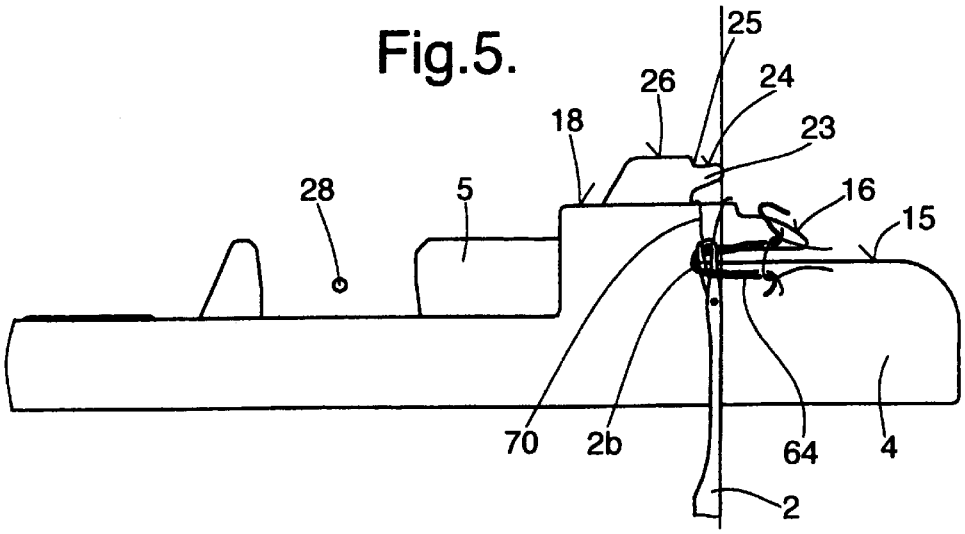

When traversing the first system section A in the knitting direction, the knitting needles 2 are firstly driven by the track section 37 into their highest position (FIG. 4). The sinkers 5 are gradually withdrawn along the track section 43 into their fully retracted position (FIG. 4), in order to make space for the ground yarn guide 48, while the sinkers 4 initially stay in the usual clearing position (FIG. 3) but are then advanced somewhat more (track section 41, FIG. 2), in order to tension the plush yarn loop formed in the preceding method cycle. All needles 2 then accept a ground yarn 68 (FIG. 4), while all old stitches 69 move on to the shanks of the needles 2 over the opening latches 2*b*. All needles 2 are then retracted to an intermediate position (FIG. 5), which is higher than the miss position (line 31) but sufficiently low to form ground yarn loops 70 and to preform these over the upper edges 18 of the sinkers 4, but not to cast them off (FIG. 5). The sinkers 5 are advanced again (FIG. 5) after the passage of the ground yarn guide 48 by the track section 43, in order to tension the preformed ground yarn loops 70 or to keep them taut, while the sinkers 4 are retracted to the normal clearing position.

Figure 6:
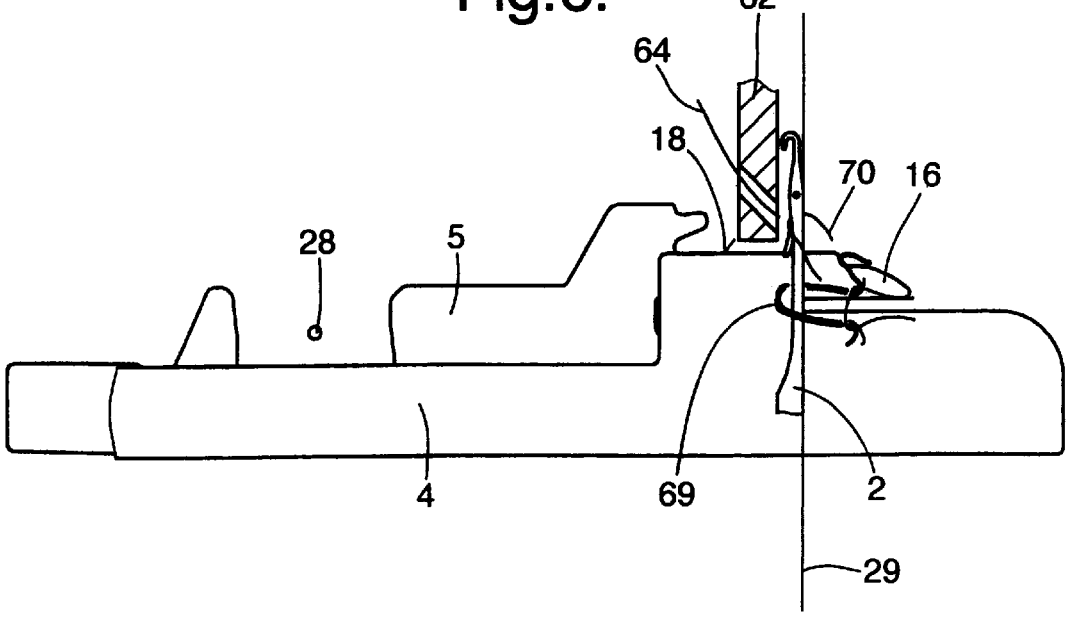
Figure 7:
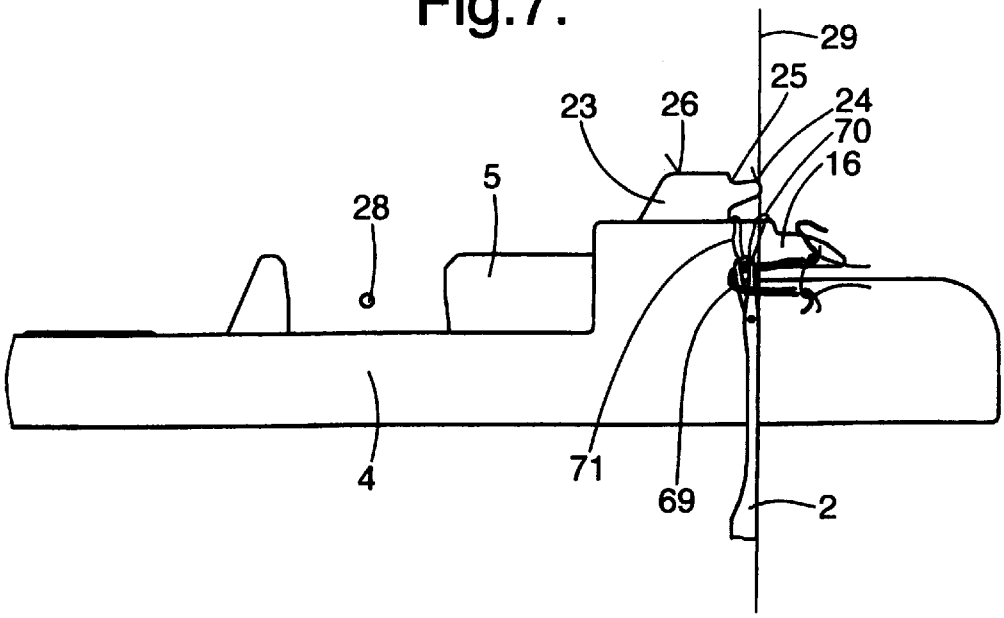

On passage into the next system section B, which is substantially identical to the system section A, those needles 2 are selected by the selector system 66 which are to receive float yarn 64 presented by the yarn guide 62 (FIGS. 2,6). The heads of these needles 2 are then raised by the track section 56 to receive the float yarn 64 (FIG. 6) and are then again retracted to the intermediate position (FIG. 7). The float yarn 64 is thereby preformed into float yarn loops 71 over the edges 18 of the sinkers 4 pertaining to the selected needles 2 (FIG. 7), while the same float yarn 64 is laid floating over the edges 18 of all those sinkers 4 which are associated with the unselected needles 2. The previously formed ground yarn loops 70 remain in the hooks of the needles or on their latches (tuck on the needle), because the ends of the opened latches always remain below the sinker edges 18 (FIG. 6).

The described method is repeated in the next system section C, with the difference that in particular different needles, if required all the needles 2 not selected in the system section B, are selected by the selector device 67 and then are raised to receive the second float yarn 65. The corresponding views in FIGS. 6 and 7 in the region of the system section C are therefore not shown separately in the drawings. After passing through the system section C, all needles 2 and sinkers 4,5 are again in the position which is shown in FIGS. 5 and 7.

Figure 8:
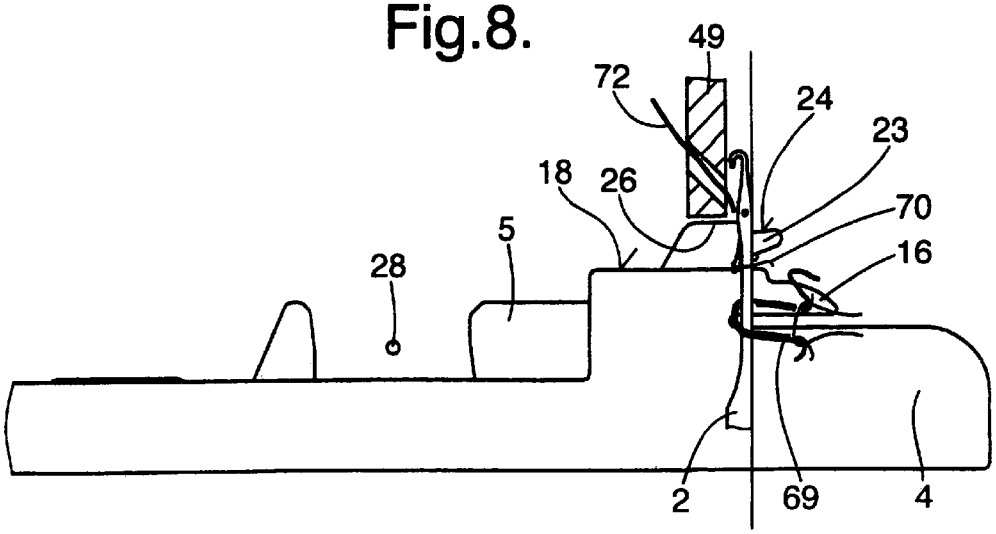
Figure 9:
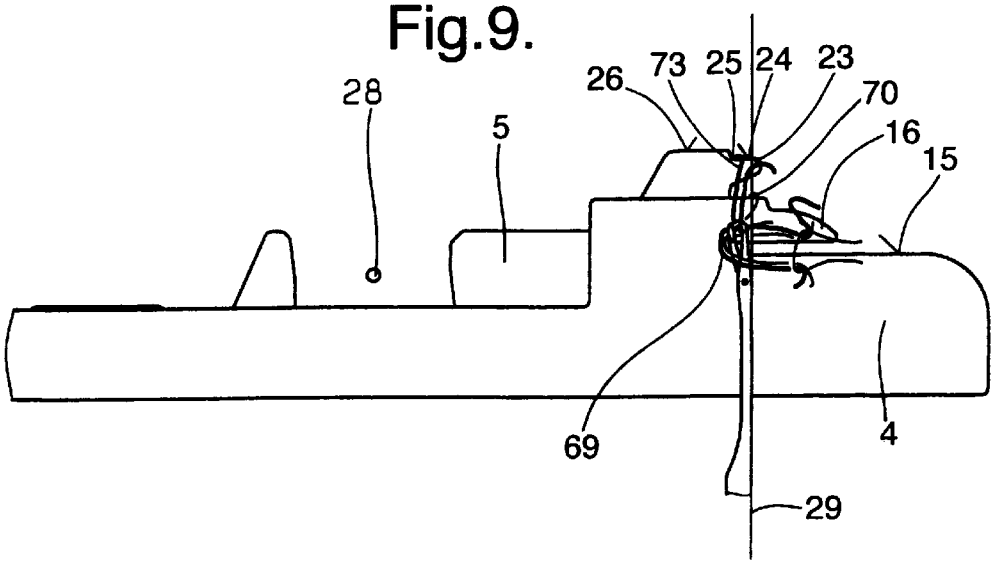

Before passing into the system section D, those needles 2 are selected by means of the selector device 52 which are to receive a plush yarn 72 presented by the plush yarn guide 49 (FIGS. 2,8). The heads of these needles 2 are then raised by the track section 38 to receive the plush yarn (FIGS. 2,8) and are then retracted again to the intermediate position (FIG. 9). The plush yarn 72 is firstly drawn over the upper edges 26 of the sinkers 5, because the plush yarn guide 49 is not just above the upper edges 18 of the sinkers 4, in contrast to the ground yarn guide 48, but is arranged above the upper edges 26 of the sinkers 5 (FIG. 8). In addition the previously formed ground yarn loop 70 cannot slip off under the ends of the opening needle latches, since the upper edges 26 of the sinkers 5 lie above the edges 18 of the sinkers 4 holding the ground yarn loops 70 by at most as much that on the one hand the ends of the opened needle latches lie below the edges 18 and thus the ground yarn loops 70 remain on the needle latches (tuck on the needle) and on the other hand the open needle hooks can be raised sufficiently far above the edges 26.

After renewed retraction of the needles 2 into the intermediate position (FIG. 9) the sinkers 5 are briefly withdrawn by means of the track section 44 (FIG. 2), whereby newly formed plush yarn loops 73 slide off the upper edge 26 over the shoulder 25, on to the slightly lower edge 24 of the nose 23 of the sinker and loosen (FIG. 9), whereby the danger of yarn breakage is reduced.

The sinkers 4 remain essentially in their clearing position during these method steps, while those needles 2 which are not to receive the plush yarn 72 remain in the intermediate position (FIGS. 5,7), so that their hooks 2*a* are closed by the old stitches 69 and moreover are held closely below the upper edges 18 of the sinkers 4.

Furthermore, in order to avoid obscurity, the float yarn loops 71 formed by the system sections B and C have been omitted in FIGS. 8 and 9.

In the following system section E the method steps described with reference to system section D are repeated, with the difference that each needle 2 not raised in the system section D is selected by the selector device 53 and is then raised by the track section 39, in order to receive plush yarn presented by the yarn guide 50. At the end of the system section E the needles 2 and sinkers 4,5 therefore assume their positions shown in FIG. 9.

In the system section F (FIG. 2) last in the knitting direction the old stitches 69 are now so knocked off over the preformed ground, float and plush yarn loops 70, 71 and 73 that the latter remain constantly under the control of the sinkers 4 and 5, in that these are so controlled during the further retraction of the needles 2 from the intermediate position to the knock-off position that at least the preformed plush yarn loops 73 are constantly held under tension. In the embodiment, the ground and float yarn loops 70,71 are transferred for this to the lower edges 15 of the sinkers 4 and the plush yarn loops 73 to a level which corresponds to the height of the upper edges 16*a* of the noses 16 of the sinkers 4.

Figure 10:
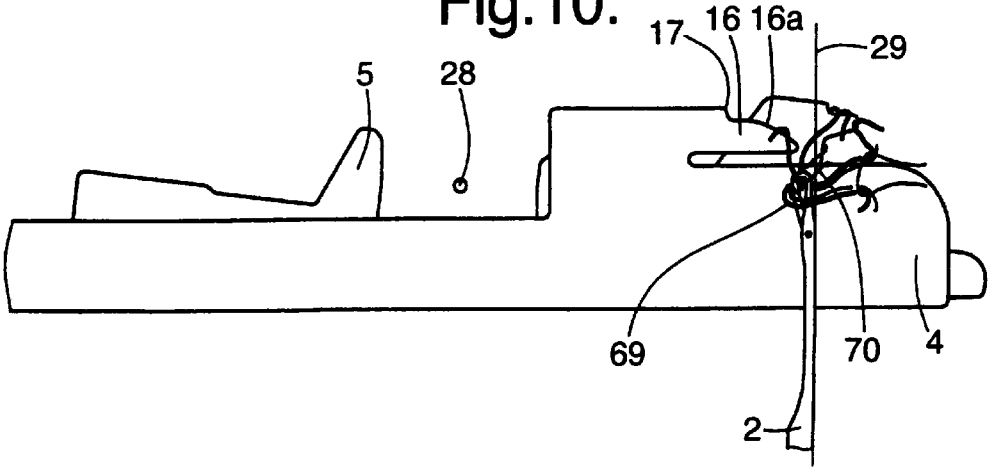
Figure 11:
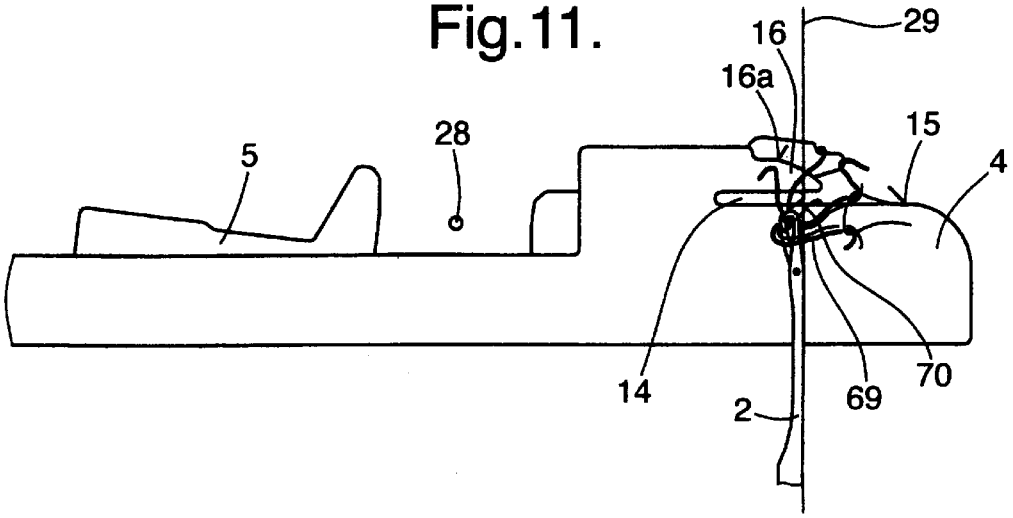
Figure 12:
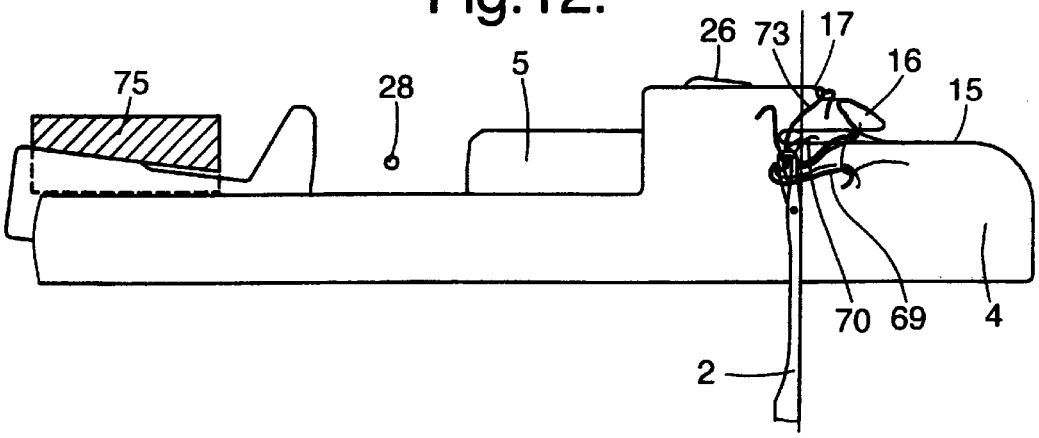
Figure 13:
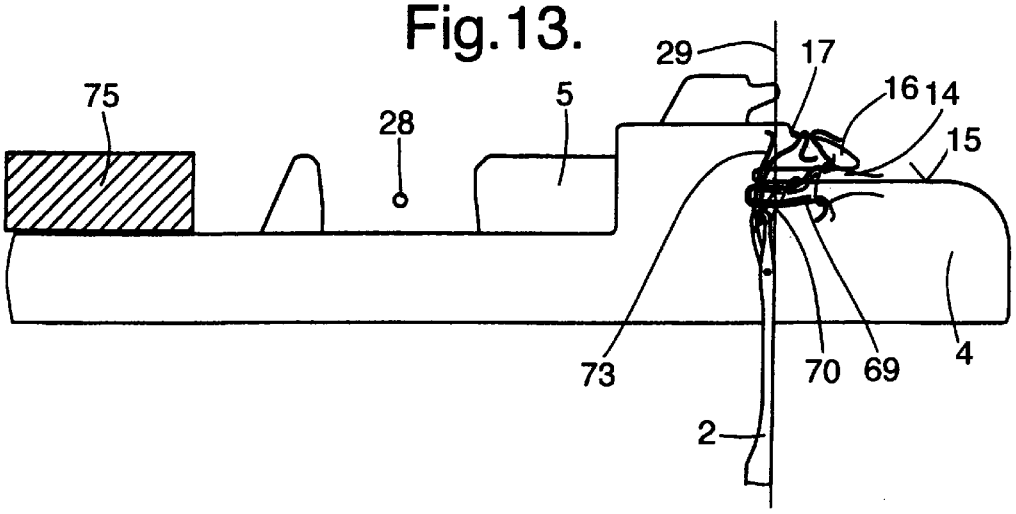

In order to transfer the ground yarn loops the sinkers 4 are initially withdrawn by means of the track section 42 until the newly formed ground and float yarn loops 70,71 have become free from the shorter noses 16 (FIG. 10) and are then advanced again, so that the ground and float yarn loops 70,71 now resting on the edges 15 pass into the slots 14 of the sinkers 4 (FIGS. 11,12). The sinkers 5 keep the ground and float yarn loops 70,71 tensioned.

As FIGS. 2 and 10 show, during the retraction of the sinkers 4, the needles 2 are simultaneously lowered by means of a track section 74 from the intermediate position into the clearing or miss position. On account of the tension thereby exerted on the plush yarn loops 73, the sinkers 5 begin to tilt about their tips 27*c*, until their limbs 27*b* rest on the bottom of the sinker channels. Since the upper edges 24 of the noses 23 are thus swung down to the extent that the needles 2 are lowered, the plush yarn loops 73 remain tightly tensioned and pulled against the shoulders 25, so that they cannot slide of the sinkers 5. The turning operation is completed around the point X—X (FIG. 10). If the sinkers 4 are now advanced further (FIG. 11) then the plush yarn loops 73 are cast off their noses 16 and if required tensioned or kept tensioned by means of the shoulders 17.

At the same time as this the sinkers 5 are retracted along the track section 46. The result of this is that their noses 23 are withdrawn from the plush yarn loops 73 and these are now held solely by the top upper edges 16*a* of the noses 16 of the sinkers 4 (FIG. 12), while at the same time the ground and float yarn loops 70,71 are disposed in the slots 14 of the sinkers 4. The needles 2 are now retracted to their lowest position along the track section 40 (FIG. 13), while the plush yarn loops 73 rest on and are finally shaped on the upper edges 16*a* and the ground and float yarn loops 70,71 on the lower edges 15 of the sinkers 4. At the same time the sinkers 5 are swung back again along the track section 47 in FIG. 2 by means of a cam system part 75 visible in FIGS. 12,13 and are moved forwards by means of the track section 46 (FIG. 13), so that the starting condition results again shortly before the position III—III and formation of the next course of stitches can be commenced.

Reference is made to DE 4 033 735 A1 for further details of the described method.

Figure 14:
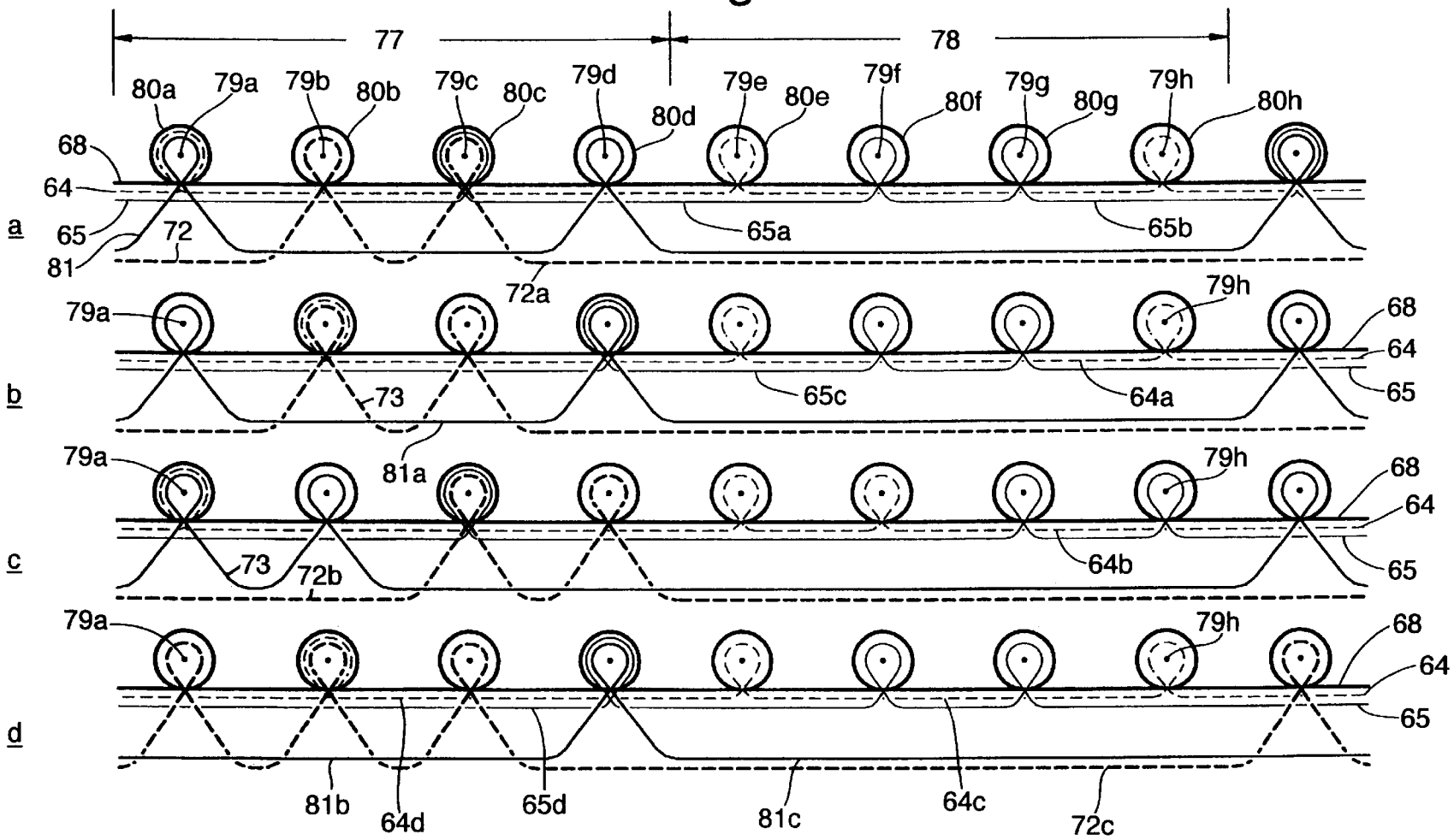
FIG. 14 is a schematic view of four courses of stitches of a plush knitwear according to the invention.
Figure 15:
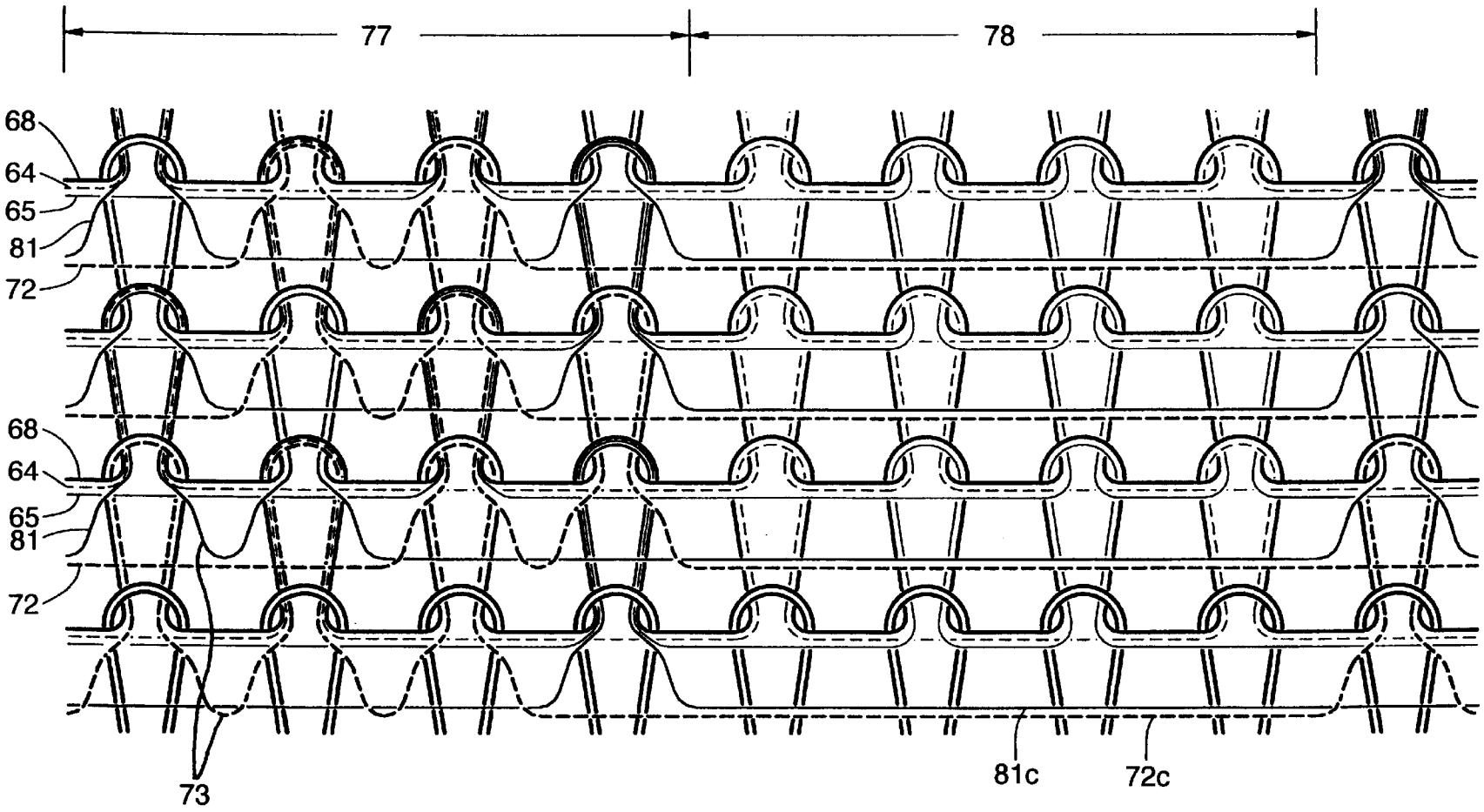
FIGS. 15 and 16 each show a section of the plush knitwear according to the invention of FIG. 14 before and after cropping respectively.
Figure 16:
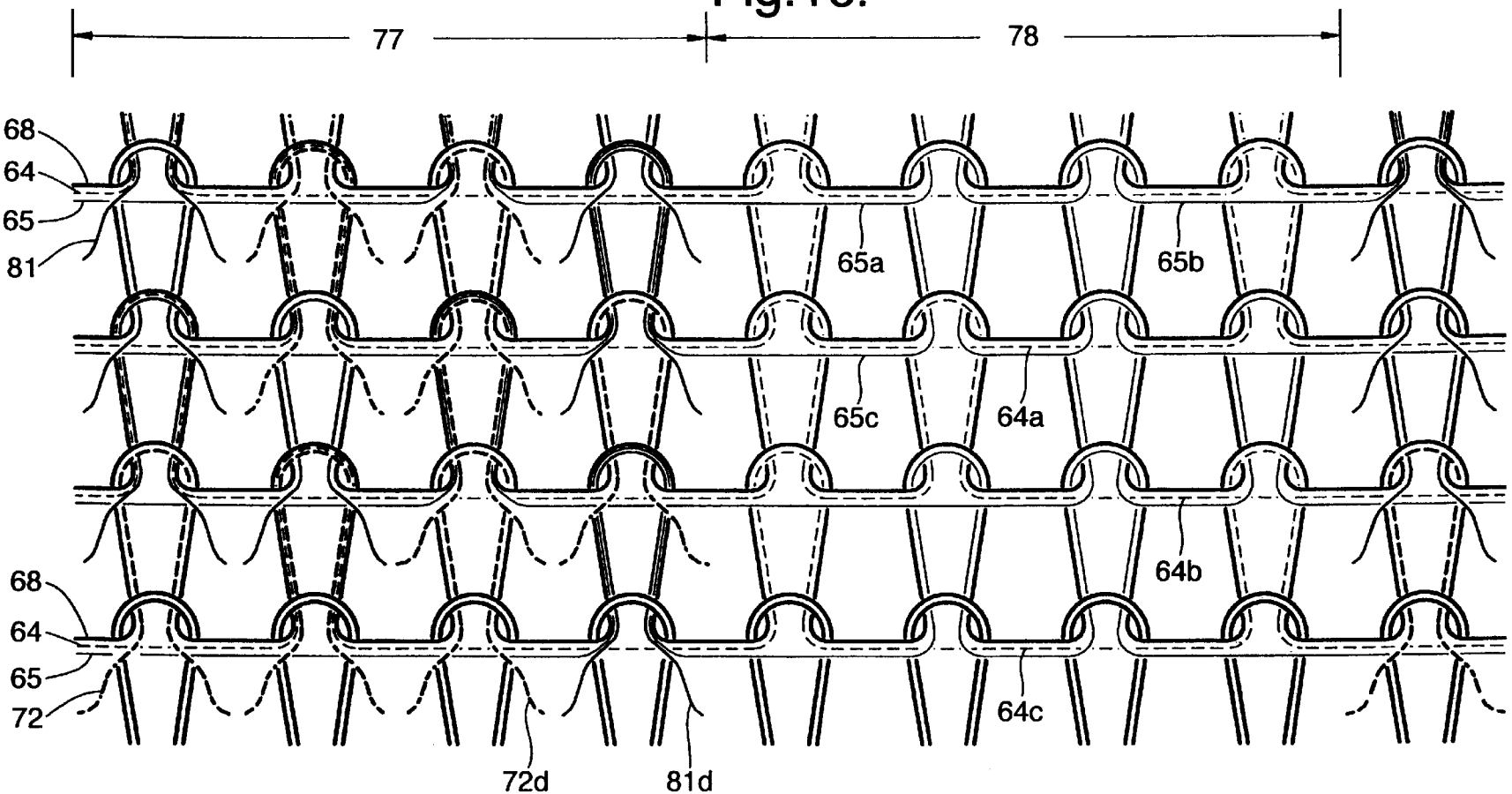

An embodiment of a two-colour high/low plush knitwear can be made with the circular knitting machine according to FIGS. 1 to 2 is shown in FIGS. 14 to 16, where in each case there is shown a high zone or portion 77 extending over four stitch wales at the left and a low zone or portion 78 on the right side, likewise extending over four stitch wales. The stitch wales at the outermost right hand edge form the start of a further high zone.

In FIG. 14, a stitch 80 or a stitch wale pertaining thereto is formed from the ground yarn 68 (FIG. 3) on each schematically represented knitting needle 79. In the same stitch course the first float yarn 64 (FIG. 2), shown in a broken line forms a stitch together with the ground yarn 68 on the first and fourth needles 79*e* and 79*h* of the zone 78, while it otherwise floats. Contrary, the second float yarn 65 (FIG. 2) shown by an unbroken line forms a stitch together with the ground yarn 68 on the second and third needles 79*f* and 79*g*, while it otherwise floats. In the stitch course b the float yarns 64,65 are correspondingly worked into stitches and left to float. On the other hand, the float yarn 64 forms a stitch within the zone 78 in the stitch course c in the stitch wales corresponding to the needles 79*e* and 79*f* and in the stitch course d in the stitch wales corresponding to the needles 79*e* and 79*h*, while the float yarn 65 in each case forms stitches in the remaining stitch wales and otherwise floats. Accordingly, floats 64*a*–64*c* and 65*a*–65*c* having different lengths as desired are formed from the float yarns 64,65, of which only some are referenced in FIG. 14 by way of example. The stitches formed from the ground yarn 68 and one of the float yarns 64,65 are a result of suitably selecting the associated needles 79 by means of the selector devices 66,67 (FIG. 2). Care is preferably taken that a full course results, i.e. in each stitch wale of the low zone 78, at least one of the float yarns 64,65 is worked into a stitch.

In a similar way, those needles 79 are selected by the selector devices 52,53 (FIG. 2) which are to form a stitch from the plush yarn 72 shown in a broken line and a further plush yarn 81 (FIG. 14) shown in an unbroken line, as is shown in FIG. 14 within the pattern zone 77, e.g. for the plush yarn 72 at the needles 79*b* and 79*c* in the stitch course a or for the plush yarn 81 at the needles 79*a* and 79*d* in the stitch course b, whereby the plush yarn loops 73 shown also in FIG. 9 or 12 result. In between these stitches the plush yarns 72,81 float, so that plush yarn floats 72*a*,72*b* and 81*a*,81*b* result, of which only some are referenced in FIG. 14.

According to a first variant of the plush knitwear according to the invention the plush yarns 72,81 can float continuously in the low zones 78 and form floats 72*c*,81*c* for example. Since the plush yarns 72,81 are formed according to the foregoing description over the edges 26 of the sinkers 5 and are therefore comparatively long, they are cut out of the knitwear in the subsequent cropping or shearing operation. Accordingly the float yarns 64,65 can float throughout the high zones 77 and form floats 64*d*,65*d* there. Since the float yarns 64,65 are formed like the ground yarns over the edges 18 of the sinkers 4, they lie relatively close to the finished base fabric and therefore remain intact like the floats 64*a*–64*c*, 65*a*–65*c* even after the cropping process.

It will further be understood that the edges between the zones 77,78 naturally run in accordance with a predetermined pattern and can accordingly vary as considered over the length of the knitwear. For example, in a further section of the knitwear and in a stitch course corresponding to the stitch course a, the needles 79*e*–79*h* could be supplied with the plush yarns 81,82 and the needles 79*a*–79*d* with the float yarns 64,65.

An advantage of the described plush knitwear lies in that the float yarns 64,65 form floats with selected lengths within the low zones, which floats are visible after the cropping process and can be so selected that they give the fabric the desired appearance in this region. This is independent of how the ground fabric made with the yarn 68 is formed and whether it is produced with one or more ground yarns. The patterned arrangement of plush and float yarns in a single ground yarn course furthermore opens up not merely a number of pattern possibilities with the tight, closely woven and clearly defined pattern, but also makes it possible to affect the structure, strength or stability of the knitting within wide limits, in accordance with requirements. In that the right side of the knitted material according to the invention consists of plush loops and the floats cover the actual ground fabric such materials finally exhibit high resistance to rubbing and wear.

If the high zones 77 are too wide for pattern reasons, there could be a danger that very long floats 64*d*,65*d* could also be cut in the cropping operation in some circumstances. In order to avoid this, these floats can be worked into stitches with the aid of selected needles 79 even in the zones 77. This is shown in FIG. 14 for example for the needles 79*a* and the float yarn 64 or for the needles 79*c* and the float yarn 65 in each case in the stitch course a. Accordingly three-yam stitches 80*a* and 80*c* are formed at these places, each consisting of the ground yarn, a plush yarn and a float yarn. The floats formed by the float yarns 64,65 can be kept short in this way and extend for example over four needles at the most. A similar procedure would naturally also be possible within the zones 78, in that three-yarn stitches are formed, each sonsisting of the ground yarn and the two participating float yarns. Apart from this the float yarns 64,65 can also be bound into the pattern zones 77 as tuck floats.

FIG. 15 shows a section of plush knitwear made according to the scheme of FIG. 14, before the cropping operation. The yarns 68 form the described ground knitting while the float yarns 64,65 form the low zones and the plush yarns 72,81 the high zones 77. After the cropping process the plush knitwear according to FIG. 16 results. This fabric is distinguished in that the plush yarn floats (e.g. 72*c*,81*c*) visible in FIG. 15 and explained in detail with reference to FIG. 14 have disappeared and only the plush tufts 72*d*,81*d* (FIG. 16) characteristic of a cut plush remain within the high zones 77. On the other hand the low zone 78 no longer has any kind of plush yam, so that its appearance is chosen essentially determined only by the float pattern chosen in the specific case and formed from the floats 64*a*–64*c*, 65*a*–65*c*. Plush and float yarns can have characteristics which differ from one another, especially colours, or even be provided with characteristics corresponding in pairs, in that the same yarn material is used for the plush and float yams 81,65 on the one hand and 72,64 on the other hand for example.

The invention is not limited to the described embodiments, which can be modified in many ways. The number of float and plush yarns can be chosen arbitrarily and differently within each ground yarn course and the ground yarn courses or the ground fabric does not all have to be in plain knitting. The ground fabric can also be formed from sub-courses in 1:1 knitting and thus have a structure or pattern. This is possible for example in that a plurality of system sections corresponding to the system section A are arranged one after the other. It would naturally also be possible to provide between stitch courses containing plush and float yarns courses without plush and/or float yarn or stitch courses which contain only the plush yarn or the float yarn.

In order to vary the number of float and/or plush yarns in a ground yarn course it is possible to alter the number of system sections B,C on the one hand and D,E on the other hand in FIG. 2 in an arbitrary way. A four colour plush pattern could be made for example with a knitting system in that there are four system sections corresponding to the system sections D,E, apart from the system sections A, B, C and F. Correspondingly a single system section D or E could be combined with an arbitrary number of system sections B,C. It is naturally also possible to provide a plurality of knitting systems in the circumferential direction of a circular knitting machine, in which the system sections are arranged in a different number and sequence. A particular advantage of the circular knitting machine according to the invention arises above all in that it is only necessary for this to interchange the cam system parts, so that a pattern change can be effected with a few movements of the hand. Unless other measures are taken, the system sections B,C for the float yarn should always precede the system sections D,E for the plush yarns, so that the plush yarn loops are not stripped off the associated sinker edges by the retraction of the sinkers 5, already before the stitch formation operation.

A further variant of the invention obviously consists in that it would not in principle be essential for the sinkers 5 to be first advanced into the position according to FIG. 5 in the system sections B,C and then to be retracted again into the position according to FIG. 6. Rather, the sinkers 5 could remain in the retracted position shown in FIG. 4 until all ground and float yarns have been laid into the selected needles. Furthermore, the described kind of method is largely independent of what technique is used to make the plush knitting in the particular case (e.g. DE 4 033 735 A1 or EP 0 295 703 A2). In particular it would be possible to use the kind of method according to the invention also with plush goods which have closed plush yarn loops, instead of plush loops formed by a cropping operation. In this case it could additionally be provided to make high/low plush goods which have plush yarn loops of different lengths, with means known per se, e.g. sinkers. Finally it will be understood that the described features of the invention can be combined with one another in ways other than those described and shown.

The disclosure in German Patent 31 45 307 (=U.S. Pat. No. 4,612,784 of Sep. 23, 1986), German Patent Application 40 33 735 of Oct. 24, 1990 (=U.S. Pat. No. 5,239,843 of Aug. 31, 1993) and German Patent Application 195 05 646 of Feb. 18, 1995 (=U.S. patent application Ser. No. 5,791, 162 of Aug. 11, 1998) are incorporated here by reference. This Patents and Application describe the invention described hereinabove and claimed in the claims appended herein below and provides the basis for a claim of priority for the instant invention under 35 U.S.C. 119.

While the invention has been illustrated and described as embodied in a circular knitting machine with a rotatable needle carrier, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. A method of making high/low plush knitwear, comprising the steps of knitting at least one first ground yarn in a plurality of stitch courses of a base fabric; bounding at least one plush yarn into the base fabric; forming at least one first portion in the base fabric with plush loops formed by the at least one plush yarn being bound into the first portion; forming at least one second portion in the base fabric without having plush loops being formed by the plush yarn; additionally bounding at least two float yarns into the base fabric; and forming each flow yarn in the second portion so that it selectively floats or is formed into stitches.

2. A knitting machine for making high/low plush fabrics, comprising means for knitting at least one first ground yarn in a plurality of stitch courses of a base fabric; means for bounding at least one plush yarn into the base fabric; means for forming at least one first portion in the base fabric with plush loops formed by the at least one plush yarn being bound into the first portion; means for forming at least one second portion in the base fabric without having plush loops being formed by the plush yarn; means for additionally bounding at least two float yarns into the base fabric; and means for forming each flow yarn in the second portion so that it selectively floats or is formed into stitches.

3. A high/low plush knitwear, comprising a base fabric having a plurality of stitch courses knitted with at least one first ground yarn and at least one plush yarn bound into said base fabric, said base fabric having at least one first portion with plush loops formed by said at least one plush yarn being bound into said first portion, and at least one second portion without having plush loops being formed by said at least one plush yarn; and at least two float yarns which are additionally bound into said base fabric, each of said float yarns in said second portion selectively floating or being formed into stitches.

4. A high/low plush knitwear as defined in claim 3, wherein said float yarns in said first portion at least partially are formed into stitches.

5. A method as defined in claim 1; and further comprising the steps of using a knitting machine with knitting elements having hooks and first and second sinkers associated therewith in pairs and adapted to be advanced and retracted transverse to the knitting elements, to which sinkers ground and plush yarns are fed for forming ground and plush yarn stitches and the plush yarn loops; laying the ground yarn firstly into the hooks of the raised knitting elements in a first system section, and preforming it into ground yarn loops over sinker edges of the first sinkers by following lowering of these knitting elements; laying at least one plush yarn into the hooks of selected knitting elements raised again in a second system section lying after the first system section in a knitting direction, and preforming it over sinker edges of the second sinkers into plush yarn loops by lowering these knitting elements; then lowering the knitting elements to a knock-over position for forming stitches of the ground and plush yarns in a third system section lying after the second system section in the knitting direction; and laying no plush yarn into the hooks of a plurality of directly adjacent knitting elements for making high/low patterns; laying at least two flow yarns into the hooks of selected, raised knitting elements in a fourth system section preceding the second system section in the knitting direction, and preforming over sinker edges of the first sinkers by following lowering of these knitting elements into float yarn loops or leaving floating, and then bounding into the ground fabric together with the ground and plush yarn loops in the third system section by being formed into stitches or leaving floating between such stitches.

6. A method as defined in claim 5; and further comprising the step of before the stitch formation, transferring the preformed ground and float yarn loops from the sinker edges serving for the preformation on to knock-over edges of the first sinkers, and transferring the plush yarn loops from the edges serving for the preformation onto knock-over edges of the first sinkers; and controlling the sinkers so that the preformed plush yarn loops are controlled and held tensioned also after retraction of the associated knitting elements into the knock-over position.

7. A method as defined in claim 5; and further comprising the step of holding the preformed plush yarn loops tensioned by tilting the second sinkers in correspondence with a further retraction of the knitting elements.

8. A method as defined in claim 5; and further comprising the step of controlling the second sinkers into a withdrawal position for the transfer of the plush yarn loops from the edges serving for the preformation onto the knock-over edges.

9. A method as defined in claim 8, wherein said transferring includes transferring the ground yarn loops first from the edges on to the edges of the first sinkers, and then transferring the plush yarn from the edges of the second sinkers on to the edges of the first sinkers.

10. A method as defined in claim 5; and further comprising the step of holding in or transferring the second sinkers into a retracted position in the preformation of the float yarn loops in the fourth system section.

11. A method as defined in claim 5; and further comprising the step of at least partially forming into stitches the float yarns in portions which have stitches formed from ground and plush yarns.

12. A knitting machine as defined in claim 2; and further comprising a needle carrier, in which knitting elements for forming ground and plush yarn loop stitches are movably mounted; at least one ground yarn guide for feeding a ground yarn; at least one plush yarn guide for feeding a plush yarn; a sinker carrier in which first and second sinkers are movably mounted, arranged in pairs, for controlling the stitch formation, the first sinkers having edges for preforming ground yarn loops; and at least one cam system arranged associated with at least one of the yarn guides for controlling the knitting elements and sinkers, the cam system arrangement having a first system section for laying the ground yarn into the hooks of the raised knitting elements and for subsequent lowering of these knitting elements for preforming ground yarn loops over the edges of the first sinkers, a second system section lying after the first system section in the knitting direction for laying the plush yarn into the hooks of selected knitting elements raised again and for subsequent lowering of these knitting elements for preforming the plush yarn loops over the edges of the second sinkers and a third system section lying the second system section in the knitting direction for lowering the knitting elements into a knock-over position for forming stitches from the ground and plush yarn; and at least two further yarn guides each for feeding a float yarn, the cam system arrangement including at least one fourth system section lying ahead in the knitting direction of the second system section, said fourth cam section including means for laying the float yarns into the hooks of knitting elements selected and raised and means for preforming float yarn loops over the edge of the first sinkers.

13. A knitting machine as defined in claim 12, wherein the means for laying in float layers include two cam system tracks acting on the knitting elements and two selector devices associated therewith.

14. A knitting machine as defined in claim 12, wherein the means for preforming include two cam system tracks acting on the second sinkers, by means of which the second sinkers are held in a retracted position or transferred to such a position during the preformation of the float yarn loops.

15. A knitting machine as defined in claim 12, wherein the second sinkers are mounted pivotally in the sinker carrier.

16. A knitting machine as defined in claim 12, wherein the second sinkers are mounted slidably transverse to the knitting elements in the sinker carrier.

17. A knitting machine as defined in claim 12, wherein the cam system arrangement is so arranged that, before the stitch formation, the preformed ground and float yarn loops are transferred from the edges serving for the preformation on to knock-over edges of the first sinkers and plush yarn loops are transferred from the edges serving the preformation on to knock-over edges of the first sinkers, and that the sinkers are so controlled that the preformed plush yarn loops are controlled and kept tensioned also during lowering of the associated knitting elements into the knock-over position.

* * * * *